US006733466B2

(12) United States Patent
Huang

(10) Patent No.: US 6,733,466 B2
(45) **Date of Patent: *May 11, 2004**

(54) PERCUSSIVE MASSAGER

(75) Inventor: Charles Huang, Taipei (TW)

(73) Assignee: HoMedics, Inc., Commerce Township, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/198,662

(22) Filed: Jul. 23, 2002

(65) Prior Publication Data

US 2002/0193712 A1 Dec. 19, 2002

Related U.S. Application Data

(63) Continuation of application No. 09/475,810, filed on Dec. 30, 1999, now Pat. No. 6,500,135.

(60) Provisional application No. 60/114,490, filed on Dec. 31, 1998.

(51) Int. Cl.[7] ..... A61H 23/02

(52) U.S. Cl. ..... 601/108; 601/111; 601/101; 601/103

(58) Field of Search ..... 601/101, 103, 601/107, 108, 110, 111, 129, 130, 131, 134, 135

(56) References Cited

U.S. PATENT DOCUMENTS

| | | | |
|---|---|---|---|
| 775,813 | A | 11/1904 | Fornander |
| 1,098,337 | A | 5/1914 | Soukup |
| 1,269,803 | A | 6/1918 | Elmen et al. |
| 1,339,179 | A | 5/1920 | Elmen |
| 1,377,140 | A | 5/1921 | North |
| 1,657,765 | A | 1/1928 | Pasque |
| 1,888,510 | A | 11/1932 | Mashek |
| 2,138,815 | A | 12/1938 | Eberly |

(List continued on next page.)

FOREIGN PATENT DOCUMENTS

| | | |
|---|---|---|
| EP | 0001833 | 5/1979 |
| GB | 498228 | 12/1938 |

*Primary Examiner*—Danton D. DeMille
*Assistant Examiner*—Quang D. Thanh
(74) *Attorney, Agent, or Firm*—Brooks Kushman P.C.

(57) ABSTRACT

A percussive massager is provided having a housing including a massage head portion and a handle portion, and a motor support unit affixable within the massage head portion. A motor is supported by the motor support unit, and an output shaft rotatably driven by the motor protrudes from the motor on either side thereof. The massager further includes a pair of vertical connecting rods each having a first end and a second end, wherein the first ends are operably connected to the output shaft such that rotation of the output shaft causes the connecting rods to reciprocate axially in an asynchronous manner. A rocker arm is attachable to the motor support unit at a central pivot axis thereof, wherein the rocker arm is operably connected to the second ends of the connecting rods and is moved about the central pivot axis by rotation of the output shaft. At least two massage nodes are operably connected to the rocker arm to form a massage surface, wherein the massage nodes are moved asynchronously toward and away from the massage head portion by each of the connecting rods to provide a percussive massage effect.

39 Claims, 3 Drawing Sheets

U.S. PATENT DOCUMENTS

| | | | |
|---|---|---|---|
| 2,466,659 | A | 4/1949 | Korpela |
| 2,964,037 | A | 12/1960 | Johnston |
| 3,094,119 | A | 6/1963 | Avedissian |
| 3,374,784 | A | 3/1968 | Brent et al. |
| 3,467,080 | A | 9/1969 | McNair |
| 3,536,064 | A | 10/1970 | Kuroda et al. |
| 3,548,811 | A | 12/1970 | Wilson |
| 3,626,934 | A | 12/1971 | Andis |
| 3,672,355 | A | 6/1972 | Ogawa et al. |
| 3,802,423 | A | 4/1974 | Pfaendler |
| 3,881,470 | A | 5/1975 | Glore |
| 4,025,809 | A | 5/1977 | Teranishi |
| 4,079,733 | A | 3/1978 | Denton et al. |
| 4,088,128 | A | 5/1978 | Mabuchi |
| 4,098,266 | A | 7/1978 | Muchisky et al. |
| 4,149,530 | A | 4/1979 | Gow |
| 4,150,668 | A | 4/1979 | Johnston |
| 4,414,963 | A | 11/1983 | Kunz |
| 4,512,339 | A | 4/1985 | McShirley |
| 4,718,408 | A | 1/1988 | Barreiro |
| 4,730,605 | A | 3/1988 | Noble et al. |
| D299,863 | S | 2/1989 | Noble et al. |
| 4,827,914 | A | 5/1989 | Kamazawa |
| 5,088,474 | A | 2/1992 | Mabuchi et al. |
| 5,159,922 | A | 11/1992 | Mabuchi et al. |
| 5,361,437 | A | 11/1994 | Zhu et al. |
| 5,447,491 | A | 9/1995 | Bellandi |
| 5,716,332 | A | 2/1998 | Noble |
| 5,772,615 | A | 6/1998 | Elder et al. |
| 5,803,916 | A | 9/1998 | Kuznets et al. |
| 5,923,107 | A | 7/1999 | Franck |
| 5,935,089 | A | 8/1999 | Shimizu |
| D415,838 | S | 10/1999 | Noble |
| 6,102,875 | A | 8/2000 | Jones |
| 6,165,145 | A | 12/2000 | Noble |

Fig. 1
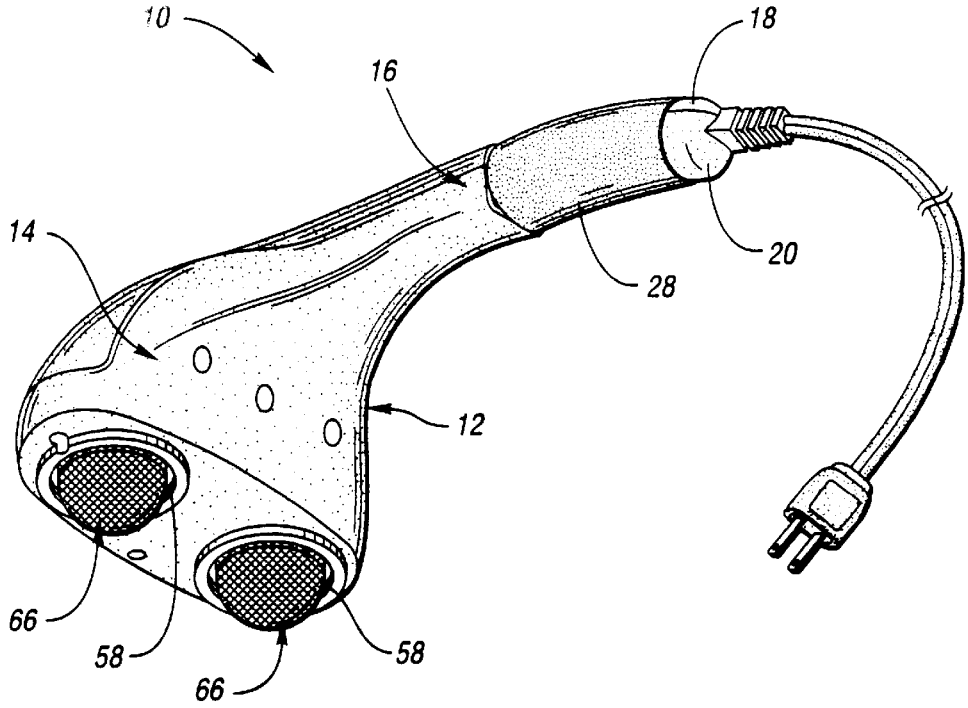
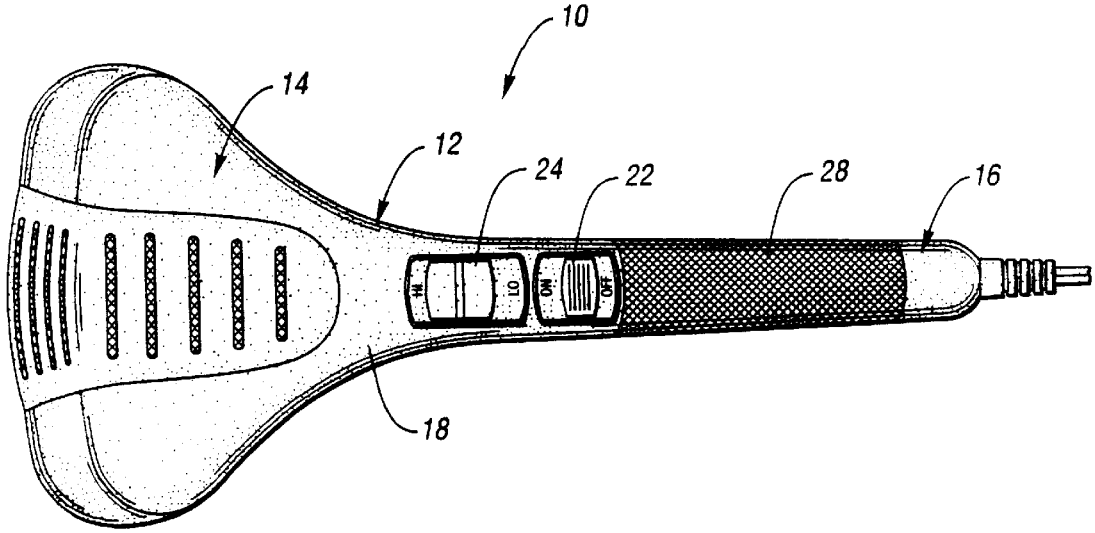
Fig. 2

PERCUSSIVE MASSAGER

CROSS-REFERENCE TO RELATED APPLICATIONS

This application is a continuation of U.S. application Ser. No. 09/475,810 filed Dec. 30, 1999 now U.S. Pat. No. 6,500,135 which, in turn, claims the benefit of U.S. provisional application Ser. No. 60/114,490 filed Dec. 31, 1998.

TECHNICAL HELD

This invention relates to a massager which exerts a percussive massage effect.

BACKGROUND ART

Power-operated massagers are often used to treat muscle tension and fatigue. Massagers that exert a percussive effect on the body are preferred over massagers which generate a rubbing action, since the latter type of massager can cause irritation or other discomfort to the recipient.

U.S. Pat. No. 4,730,605 issued to Noble et al. discloses one such percussive massager. The massager has a casing with two handles, and is intended for two-handed operation. U.S. Pat. No. 5,716,332 issued to Noble discloses a similar percussive massager that is designed so as to be capable of use for self massage. In both massagers, the massage head is coupled to a base structure for pivotal rocking movement about a pivot axis for exerting a percussive massage effect.

More particularly, the massagers referenced above each include a weight is affixed to the drive shaft of the motor. The weight has a vertical arm attached eccentrically thereto, such that rotation of the drive shaft causes the vertical arm to move axially. The vertical arm is coupled to a first massage formation, which is in turn connected to a second massage formation by a rigid surface. Movement of the vertical arm causes the first massage formation to be moved upwardly and downwardly, and in turn causes the second massage formation to be moved in the opposite direction about a central pivot. Unfortunately, this design has the disadvantage that movement of the first and second massage formations are both controlled by the same vertical arm and are not moved independently. Consequently, if the vertical arm breaks, the movement of both massage formations ceases.

DISCLOSURE OF INVENTION

Therefore, it is a principal object of the present invention to provide a percussive massager having massage nodes that are moved independently.

Accordingly, a percussive body massager having independently movable massage nodes is provided. The massager has a housing that includes a massage head portion and a handle portion, and a motor support unit affixed within the massage head portion. A motor is supported by the motor support unit, and rotatably drives an output shaft that protrudes from either side of the motor. The massager further includes a pair of connecting rods each having a first end and a second end. The first ends of the connecting rods are operably connected to the output shaft such that rotation of the output shaft causes the connecting rods to reciprocate axially in an asynchronous manner. A rocker arm is attached to the motor support unit at a central pivot axis thereof and is operably connected to the second ends of the connecting rods. During rotation of the output shaft, the rocker arm is moved about the central pivot axis. At least two massage nodes are operably connected to the rocker arm to form a massage surface, wherein the massage nodes are moved asynchronously toward and away from the massage head portion by each of the connecting rods to provide a percussive massage effect.

In accordance with a preferred embodiment of the present invention, the pair of connecting rods are operably connected to the output shaft by a pair of crank arms affixed to each end of the output shaft. To provide the asynchronous movement, one connecting rod is attached to one crank arm in a first offset location with respect to a longitudinal axis of the output shaft, and the other connecting rod is attached to the other crank arm in a second offset location with respect to the longitudinal axis of the output shaft. Preferably, the first offset location is 180 degrees from the second offset location.

In further accordance with the preferred embodiment, the rocker arm includes connectors, such as screws, extending therefrom for securing the massage nodes to the rocker arm. Advantageously, the massage nodes can then be removed and interchanged with another set of massage nodes. The rocker arm preferably further includes protrusions and corresponding cavities formed in transversely spaced apart end portions of the rocker arm which are operably connected to the second ends of the connecting rods. Resilient sleeves are affixed to the interior of the housing and sized to receive the protrusions, and the sleeves are operable to expand and contract in response to movement of the rocker arm by the motor. In a preferred embodiment, the output shaft can be rotated at a plurality of speeds through actuation of a variable speed lever.

Still further, the housing is preferably constructed from a plastic material and assembled from a top housing part and a bottom housing part. According to a preferred embodiment, the massage nodes are hemispherically shaped, have an internal frame constructed from a plastic material, and have an exterior surface constructed from a resilient material to impart the percussive massage effect.

The above objects and other objects, features, and advantages of the present invention are more readily understood from a review of the attached drawings and the accompanying specification and claims.

BRIEF DESCRIPTION OF DRAWINGS

FIG. 1 is a bottom perspective view of the percussive body massager in accordance with the present invention;

FIG. 2 is a top plan view of the percussive body massager of FIG. 1;

BEST MODE FOR CARRYING OUT THE INVENTION

Figure 3:
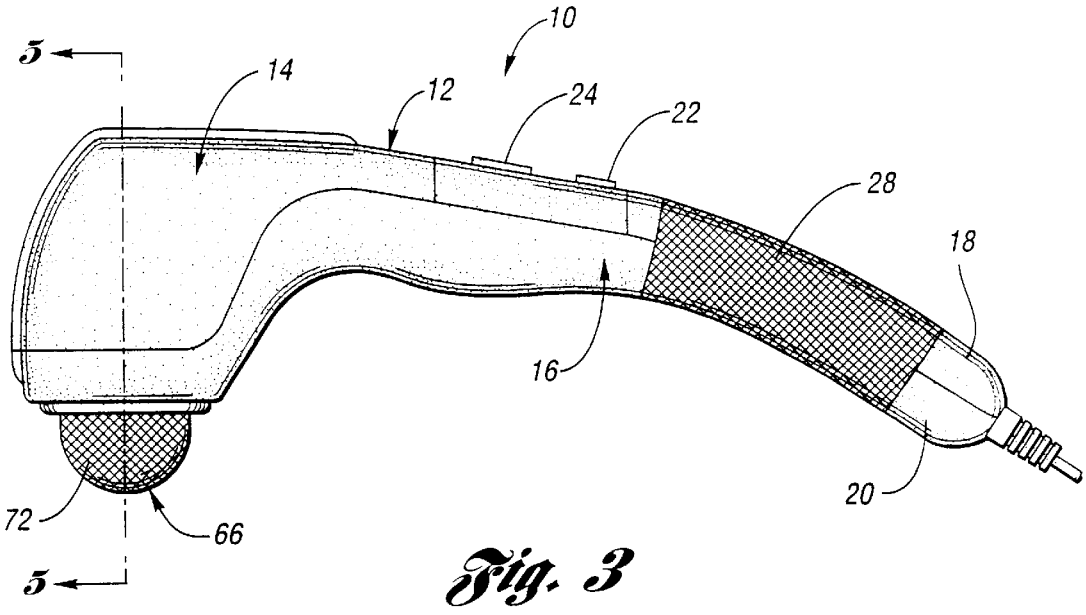
FIG. 3 is a side elevational view of the percussive body massager of FIG. 1.

Referring to FIGS. 1–3, a percussive body massager in accordance with the present invention is shown and indicated by reference numeral 10. Massager 10 comprises a housing 12 formed generally as two portions, a massage head 14 and a handle 16. Housing 12 is preferably constructed from a plastic material and is assembled from two parts, a top part 18 and a bottom part 20. Massager 10 is advantageously constructed to be light enough for an operator to use it with only one hand if desired.

As shown in FIGS. 1–3, handle portion 16 is preferably elongate and extends perpendicularly from massage head 14. Handle 16 preferably contains slidable switches for operator use, as best shown in the top plan view of FIG. 2, which are located on top housing part 18 for convenient operator viewing. The switches include an on/off switch 22 and a variable speed lever 24 electrically connected to a circuit board assembly 26 (best shown in FIG. 4). Advantageously, variable speed lever 24 is not limited to discrete speed levels, but rather can be slidingly located at many different massage speeds to achieve the precise speed desired by the operator. Massager 10 of the present invention is capable of providing a high intensity massage of approximately 3,000 pulses per minute. To adjust the intensity of the massage, an operator simply slides speed lever 24 in one direction for higher intensity or in the opposite direction for lower intensity. Of course, massager 10 can alternatively incorporate on/off and speed selection switches other than slidable type switches.

Still referring to FIGS. 1–3, handle 16 is designed to have an arc, thereby facilitating the use of massager 10 by an operator on his/her own back. In addition, handle 16 is also preferably contoured to facilitate a user's grasp and is provided with a foam cushion 28 to provide an operator with easy and comfortable grip.

Figure 5:
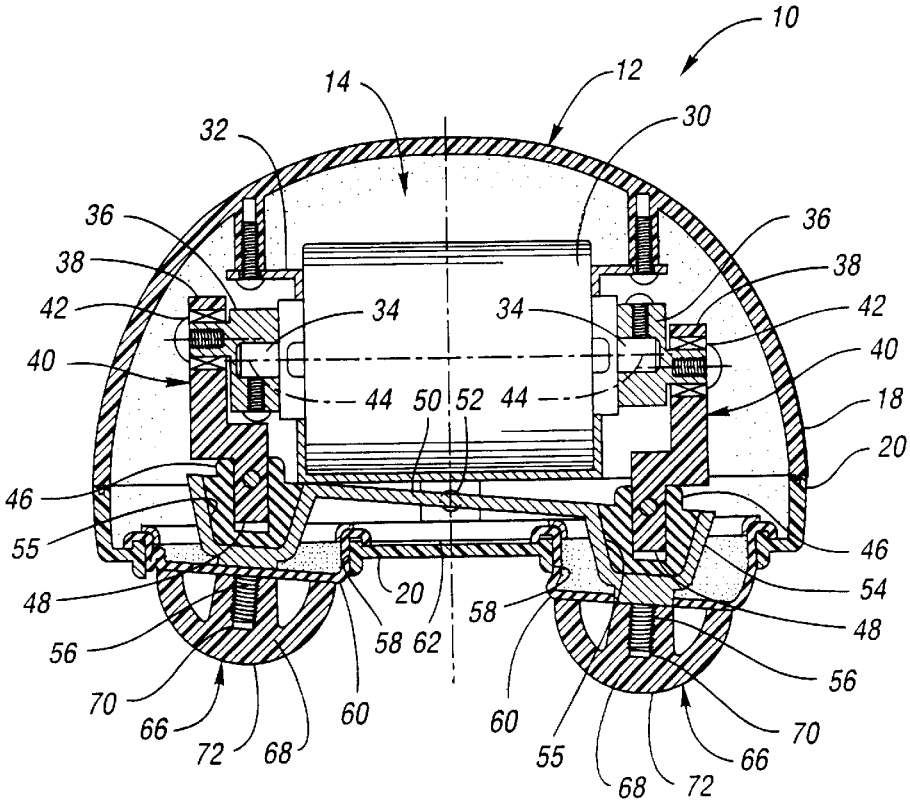
FIG. 5 is an end, cross-sectional view of the massage head portion of the percussive body massager taken along line 5—5 of FIG. 3.
Figure 4:
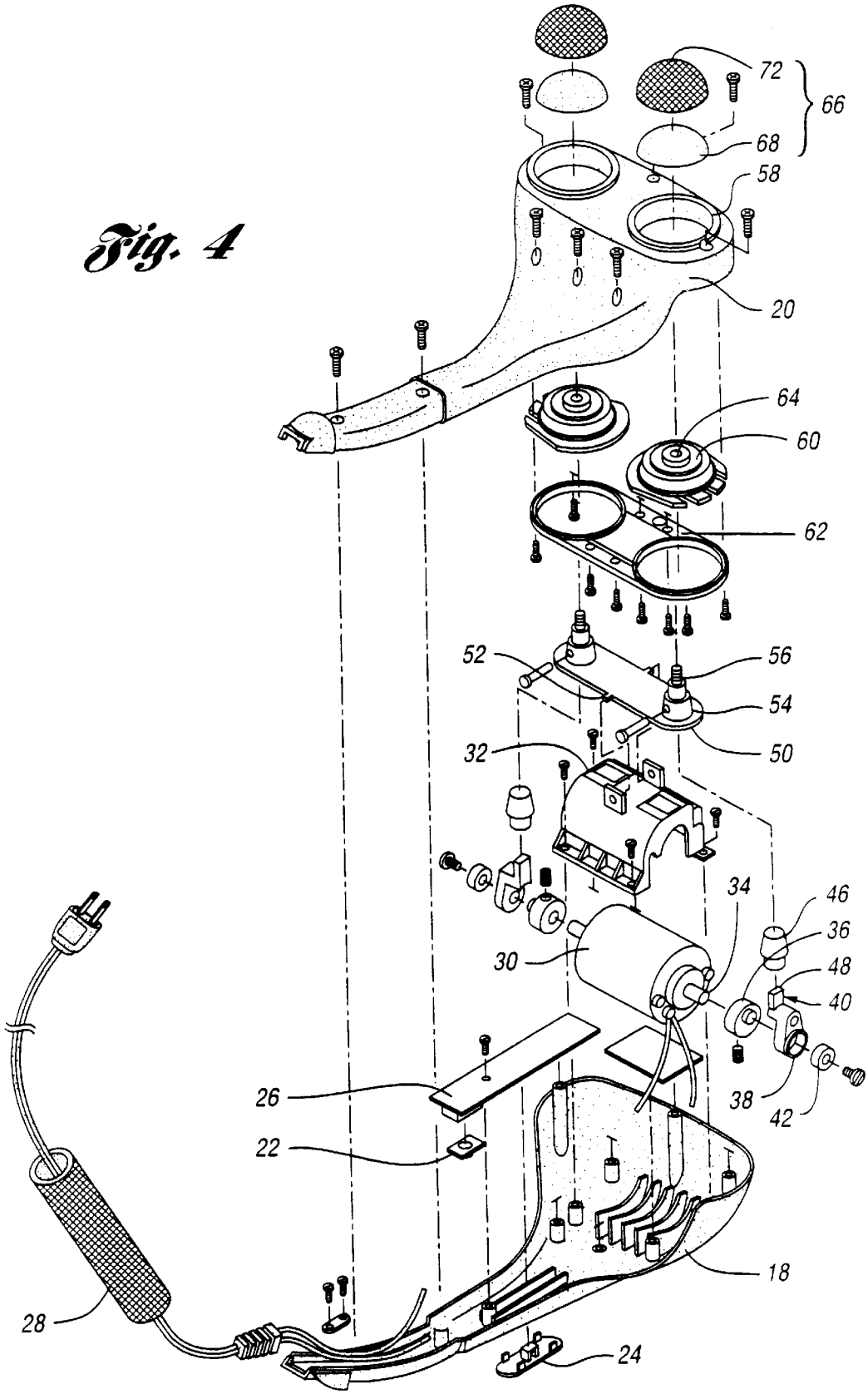
FIG. 4 is an exploded view of the percussive body massager of the present invention.

Referring now to the exploded view of FIG. 4 and the cross-section view of FIG. 5 (taken along line 5—5 of FIG. 3), massager 10 is provided with an electric motor 30 which is disposed within massage head portion 14 of top housing part 18. Massager 10 is generally symmetrical about a plane which is perpendicular to the motor axis. Motor 30 is partially surrounded and preferably suspended above a massage surface, which is described below, by a motor support unit 32 affixed within massage head 14. An output shaft 34 is rotatably driven by motor 30 and protrudes from motor 30 on either side thereof. A crank arm 36 is affixed to each end of output shaft 34 adjacent motor 30, so that crank arms 36 rotate along with output shaft 34. To the outside of each crank arm 36, a first end 38 of a vertical connecting rod 40 is affixed eccentrically, preferably with a rotary bearing 42 (best shown in FIG. 4) in between crank arm 36 and connecting rod 40.

In operation, the rotation of output shaft 34 by motor 30 causes each connecting rod 40 to reciprocate axially. More specifically, on one side of motor 30 the connecting rod 40 is attached to the crank arm 36 in a first offset location, such as above a longitudinal axis 44 of output shaft 34, depicted as the left connecting rod 40 in FIG. 5. On the other side of motor 30 the connecting rod 40 is attached to the crank arm 36 at a second offset location. The second offset location is preferably 180 degrees from the first offset location, such as below longitudinal axis 44 of output shaft 34 as depicted for the right connecting rod 40 in FIG. 5. Therefore, as output shaft 34 rotates, connecting rods 40 are moved up and down asynchronously due to their different eccentric attachment locations.

Still referring to FIGS. 4 and 5, a stud 46, preferably formed from a resilient material such as rubber, is affixed to a second end 48 of each connecting rod 40. Rubber studs 46 are in turn connected to an elongated rocker arm 50, which is attached to motor support unit 32 at a central pivot axis 52. More specifically, rocker arm 50 includes transversely spaced apart end portions 53 having protrusions 54 and corresponding cavities 55 aligned and sized to receive rubber studs 46. Rubber studs 46, and therefore connecting rods 40, are affixed to either end of rocker arm 50 in this manner, such that rocker arm 50 is moved about central pivot axis 52 upon the rotation of output shaft 34. Since each connecting rod 40 has a separate attachment to rocker arm 50, each connecting rod 40 can operate independently to cause the movement of rocker arm 50 about central pivot axis 52. Therefore, this design allows massager 10 of the present invention to continue to function and exert its percussive massage effect even if one connecting rod 40 or its attachments becomes inoperative for any reason.

As shown in FIGS. 4 and 5, each protrusion 54 has a connector, such as screw 56, extending therefrom. In massage head portion 14 of bottom housing part 20, two transversely spaced apart circular apertures 58 are formed. Sleeves 60 are affixed to the interior of bottom housing part 20, covered by a mounting plate 62 to provide support, and positioned to extend through apertures 58 thereby generally sealing apertures 58. In a preferred embodiment, the interior surface of sleeves 60 is formed to mate with the design of protrusions 54, and sleeves 60 are annular and provided with a hole 64 through which screws 56 extending from protrusions 54 can project. Sleeves 60 are composed of a resilient material such as rubber, and are constructed to be able to expand and contract through apertures 58 as dictated by the movement of rocker arm 50 in response to motor 30.

Therefore, screws 56 extending from protrusions 54 project out of bottom housing part 20 through sleeves 60 and apertures 58. At least two massage nodes 66, preferably hemispherically-shaped, are provided to be removably fastened to screws 56 and extend at least partially outside of housing 12 in order to provide the massage surface (see FIGS. 1–5). It is understood, of course, that more than two massage nodes 66 may be included in the massage surface and that massage nodes 66 can have any shape suitable to impart the desired massage effect. Massage nodes 66 preferably have a plastic, generally hemispherical internal frame 68 that includes a threaded cylinder 70 such that each massage node 66 can be fastened to each screw 56. Exterior surface members 72 of massage nodes 66 comprise a resilient, preferably rubber material. Preferably, alternate sets (not shown) of massage nodes 66 are provided for attachment to massager 10 of the present invention. The sets of massage nodes 66 would be of different densities to provide the options of soft, medium, or hard massage application. To change to a different set, an operator can simply unscrew the set that is currently attached to massager 10 via screws 56 and screw in the desired set.

In summary, percussive body massager 10 of the present invention operates as follows. Motor 30 rotatably drives output shaft 34, which in turn rotates affixed crank arms 36 to cause asynchronous, axial movement of eccentrically attached connecting rods 40. Rubber studs 46 affixed to connecting rods 40 interface with rocker arm 50 to cause it to move back and forth about its central pivot attachment 52 to motor support unit 32. From protrusions 54 formed in rocker arm 50, screws 56 extend through rubber sleeves 60 designed to expand and contract through apertures 58 formed in massage head portion 14 of bottom housing part 20. Massage nodes 66 which form the massage surface are fastened to these screws 56, such that the massage nodes 66 are moved asynchronously and independently by connecting rods 40 toward and away from massage head 14 to provide a percussive massage effect. Advantageously, the design of massager 10 assures that massage nodes 66 will continue to function properly even if one connecting rod 40 becomes inoperative.

It is understood, of course, that while the form of the invention herein shown and described constitutes a preferred embodiment of the invention, it is not intended to illustrate all possible forms thereof. It will also be understood that the words used are words of description rather than limitation, and that various changes may be made without departing from the spirit and scope of the invention disclosed.

What is claimed is:

1. A percussive massager, comprising:

a housing;

a motor mounted in the housing;

an output shaft rotatably driven by the motor and having two axially spaced apart ends protruding therefrom;

a pair of drive members attached to the output shaft ends such that an engagement surface of each drive member is not concentric with a longitudinal axis of the output shaft;

a pair of connecting rods each having a first end and a second end, wherein the first ends each cooperate with the engagement surface of one of the opposed drive members such that rotation of the output shaft causes the connecting rods to reciprocate axially in an asynchronous manner;

a rocker arm pivotably mounted relative to the housing and having a central pivot axis, wherein opposed ends of the rocker arm are operably connected to the second ends of the connecting rods, causing the rocker arm to be moved about the pivot axis by rotation of the motor output shaft; and a massage formation operably connected to the rocker arm and having first and second sides spaced on opposite sides of the rocker arm pivot axis, wherein the first and second sides of the massage formation are moved with the rocker arm by each of the connecting rods to provide a percussive massage effect.

2. The massager according to claim 1, wherein the drive members include a pair of crank arms affixed to each end of the output shaft, wherein one connecting rod is attached to one crank arm in a first offset location with respect to a longitudinal axis of the output shaft, and the other connecting rod is attached to the other crank arm in a second offset location with respect to the longitudinal axis of the output shaft.

3. The massager according to claim 2, wherein the first offset location is about 180 degrees from the second offset location.

4. The massager according to claim 1, wherein the output shaft can be rotated at a plurality of speeds through actuation of a variable speed switch.

5. The massager according to claim 1, wherein the massage formation includes at least two generally hemispherically shaped massage nodes.

6. The massager according to claim 1, wherein the massage formation includes an exterior surface member constructed from a resilient material.

7. A percussive massager, comprising:

a housing including a massage head portion and a handle portion;

a motor support unit affixable within the massage head portion;

a motor supported by the motor support unit;

an output shaft rotatably driven by the motor and having two axially spaced apart ends protruding therefrom;

a pair of drive members attached to the output shaft ends such that an engagement surface of each drive member is not concentric with a longitudinal axis of the output shaft;

a pair of connecting rods each having a first end and a second end, wherein the first ends each cooperate with the engagement surface of one of the opposed drive members such that rotation of the output shaft causes the connecting rods to reciprocate axially in an asynchronous manner;

a rocker arm attached to the motor support unit at a pivot axis thereof, wherein the rocker arm is operably connected to the second ends of the connecting rods and is moved about the pivot axis by rotation of the output shaft; and at least two massage nodes operably connected to the rocker arm to form a massage surface, wherein the massage nodes are moved toward and away from the massage head portion by each of the connecting rods to provide a percussive massage effect.

8. The massager according to claim 7, wherein the drive members include a pair of crank arms affixed to each end of the output shaft, wherein one connecting rod is attached to one crank arm in a first offset location with respect to a longitudinal axis of the output shaft, and the other connecting rod is attached to the other crank arm in a second offset location with respect to the longitudinal axis of the output shaft.

9. The massager according to claim 8, wherein the first offset location is about 180 degrees from the second offset location.

10. The massager according to claim 7, wherein the rocker arm includes connectors extending therefrom for securing the massage nodes to the rocker arm.

11. The massager according to claim 7, wherein the massage nodes are removable and interchangeable with another set of massage nodes.

12. The massager according to claim 7, further comprising studs affixed to the second ends of each connecting rod.

13. The massager according to claim 12, wherein the rocker arm includes protrusions and corresponding cavities that are aligned and sized to receive the studs.

14. The massager according to claim 13, further comprising resilient sleeves affixed to the interior of the housing and sized to receive the protrusions, wherein the sleeves are operable to expand and contract in response to movement of the rocker arm by the motor.

15. The massager according to claim 7, wherein the output shaft can be rotated at a plurality of speeds through actuation of a variable speed switch.

16. The massager according to claim 7, wherein the housing is constructed from a plastic material.

17. The massager according to claim 7, wherein the massage nodes are generally hemispherically shaped.

18. The massager according to claim 7, wherein the massage nodes have an internal frame constructed from a plastic material.

19. The massager according to claim 7, wherein the massage nodes have an exterior surface member constructed from a resilient material.

20. A percussive massager comprising:

a housing including a massage head portion and a handle portion;

a motor support unit affixable within the massage head portion;

a motor supported by the motor support unit;

an output shaft rotatably driven by the motor and protruding from the motor on either side thereof;

a pair of crank arms affixed to each end of the output shaft;

a pair of connecting rods each having a first end and a second end, wherein the first ends are attached to the crank arms in locations offset from a longitudinal axis of the output shaft such that rotation of the output shaft causes the connecting rods to reciprocate axially in an asynchronous manner;

a rocker arm attached to the motor support unit at a central pivot axis thereof, the rocker arm including protrusions which are operably connected to the second ends of the connecting rods, wherein the rocker arm is moved about the central pivot axis by rotation of the output shaft;

resilient sleeves affixed to the interior of the housing and sized to receive the protrusions, wherein the sleeves are operable to expand and contract in response to movement of the rocker arm by the motor; and at least two massage nodes operably connected to the rocker arm to form a massage surface, wherein the massage nodes are moved asynchronously toward and away from the massage head portion by each of the connecting rods to provide a percussive massage effect.

21. The massager according to claim 20, wherein the protrusions include connectors extending therefrom for removably securing the massage nodes to the rocker arm.

22. The massager according to claim 21, wherein the connectors include screws and the massage nodes each include a corresponding threaded portion.

23. The massager according to claim 20, wherein the massage nodes are generally hemispherically shaped and are at least partially constructed from a resilient material.

24. A percussive massager, comprising:

a housing;

a motor transversely mounted within the housing, the motor having a rotary output shaft with opposed ends protruding from opposite ends of the motor;

a pair of connecting rods each having a first end and a second end, wherein the first ends of the connecting rods are rotatably connected to the opposed ends of the output shaft at locations eccentrically spaced about the axis of rotation of the output shaft to cause the second ends of the connecting rods to reciprocate in an asynchronous manner as the output shaft rotates;

an elongated rocker arm having a central pivot axis, wherein the rocker arm is pivotably mounted relative to the housing and includes a pair of transversely spaced apart end portions each operably connected to the second ends of the connecting rods, causing the rocker arm to rock about the central pivot axis as the connecting rod second ends reciprocate; and two transversely spaced apart massage nodes which at least partially project from the housing, each massage node operably connected to one of the spaced apart end portions of the rocker arm and associated connecting rod second end, wherein the massage nodes move asynchronously toward and away from the housing providing a percussive massage effect in response to rotation of the output shaft.

25. The massager according to claim 21, further comprising a pair of crank arms affixed to an end of the motor output shaft and provided with an eccentric attachment location for connecting the first ends of the connecting rod to the output shaft.

26. The massager according to claim 25, further comprising rotary bearings at a junction of the eccentric attachment location and the connecting rod first end.

27. The massager according to claim 24, further comprising a rubber stud interposed between the connecting rod second end and the rocker arm end portion.

28. The massager according to claim 27, wherein the rocker arm end portion is provided with protrusions which each define a cavity sized to receive the rubber stud.

29. The massager according to claim 28, wherein the protrusion is provided with a connector for removably receiving a massage node thereon.

30. The massager according to claim 29, wherein the connector includes a screw and the massage node has a corresponding threaded portion.

31. The massager according to claim 24, wherein the housing has two transversely spaced apart apertures sized to enable the massage nodes to pass therethrough.

32. The massager according to claim 24, further comprising a pair of flexible annular sleeves mounted to the housing and generally sealing the apertures, each sleeve having a central opening sized to enable a connector to pass therethrough for mounting the massage node.

33. The massager according to claim 32, further comprising a mounting plate for mounting the annular sleeves to the housing.

34. The massager according to claim 24, further comprising a motor support partially surrounding the motor and mounting the motor within the housing.

35. The massager according to claim 24, wherein each massage node is generally hemispherically shaped.

36. The massager according to claim 24, wherein each massage node includes an internal frame formed of a plastic material and an exterior surface member formed of a resilient material.

37. A percussive massager, comprising:

a housing;

a motor transversely mounted within the housing, the motor having a rotary output shaft with opposed ends protruding from opposite ends of the motor;

a pair of connecting rods each having a first end and a second end, wherein the first ends of the connecting rods are rotatably connected to the opposed ends of the output shaft at locations eccentrically spaced about the axis of rotation of the output shaft to cause the second ends of the connecting rods to reciprocate in an asynchronous manner as the output shaft rotates;

a pair of crank arms affixed to an end of the motor output shaft and provided with an eccentric attachment location for connecting the first ends of the connecting rod to the output shaft;

rotary bearings positioned at a junction of the eccentric attachment location and the connecting rod first end;

an elongated rocker arm having a central pivot axis, wherein the rocker arm is pivotably mounted relative to the housing and includes a pair of transversely spaced apart end portions each operably connected to the second ends of the connecting rods, wherein the rocker arm is caused to rock about the central pivot axis as the connecting rod second ends reciprocate; and two transversely spaced apart massage nodes which at least partially project from the housing, each massage node operably connected to one of the spaced apart end portions of the rocker arm and associated connecting rod second end, wherein the massage nodes move asynchronously toward and away from the housing providing a percussive massage effect in response to rotation of the output shaft.

38. A percussive massager, comprising:

a housing having two transversely spaced apart apertures formed therein;

a motor transversely disposed within the housing, the motor having a rotary output shaft with opposed ends protruding from opposite ends of the motor;

a motor support affixed within the housing and partially surrounding the motor;

a pair of connecting rods each having a first end and a second end, wherein the first ends of the connecting rods are rotatably connected to the opposed ends of the output shaft at locations eccentrically spaced about the axis of rotation of the output shaft to cause the second ends of the connecting rods to reciprocate in an asynchronous manner as the output shaft rotates an elongated rocker arm having a central pivot axis, wherein the rocker arm is pivotably mounted relative to the housing and includes a pair of transversely spaced apart end portions each operably connected to the second ends of the connecting rods, wherein the rocker arm is caused to rock about the central pivot axis as the connecting rod second ends reciprocate; and two transversely spaced apart massage nodes which at least partially project from the housing through the apertures, each massage node including a generally hemispherically shaped frame and a resilient exterior surface member, wherein each massage node is operably connected to one of the spaced apart end portions of the rocker arm and associated connecting rod second end, wherein the massage nodes move asynchronously toward and away from the housing providing a percussive massage effect in response to rotation of the output shaft.

39. A percussive massager comprising:

a housing having two transversely spaced apart apertures formed therein;

a motor disposed within the housing, the motor having a rotary output shaft with opposed ends protruding from opposite ends of the motor;

a motor support affixed within the housing and at least partially surrounding the motor;

a pair of crank arms affixed to the opposed ends of the output shaft, each crank arm provided with an attachment location eccentrically spaced about the axis of rotation of the output shaft;

a pair of connecting rods each having a first end and a second end, wherein the first ends of the connecting rods are operably connected to the crank arms at the attachment locations to cause the second ends of the connecting rods to reciprocate in an asynchronous manner as the output shaft rotates;

rotary bearings positioned at a junction of the crank arm attachment locations and the connecting rod first ends;

an elongated rocker arm having a central pivot axis, wherein the rocker arm is pivotably mounted relative to the housing and includes a pair of transversely spaced apart end portions each operably connected to one of the connecting rod second ends, the rocker arm end portions including protrusions which each define a corresponding cavity and have a connector extending therefrom, wherein the rocker arm is caused to rock about the central pivot axis as the connecting rod second ends reciprocate;

rubber studs interposed between the connecting rod second ends and the rocker arm end portions, wherein the rubber studs are received in the rocker arm cavities;

a pair of flexible annular sleeves mounted to the housing and each having a central opening sized to enable one of the connectors to pass therethrough; and two transversely spaced apart massage nodes which at least partially project from the housing through the apertures, each massage node including a generally hemispherically shaped frame and a resilient exterior surface member, wherein each massage node is connected by one of the connectors to one of the spaced apart end portions of the rocker arm and associated connecting rod second end, wherein the massage nodes move asynchronously toward and away from the housing providing a percussive massage effect in response to rotation of the output shaft.

* * * * *

UNITED STATES PATENT AND TRADEMARK OFFICE

CERTIFICATE OF CORRECTION

PATENT NO. : 6,733,466 B2
DATED : May 11, 2004
INVENTOR(S) : Charles Huang

It is certified that error appears in the above-identified patent and that said Letters Patent is hereby corrected as shown below:

Column 7,
Line 54, delete “21” and insert -- 24 --.

Signed and Sealed this

Twenty-seventh Day of July, 2004

JON W. DUDAS
*Acting Director of the United States Patent and Trademark Office*